US007849657B2

(12) United States Patent
Schnepf et al.

(10) Patent No.: US 7,849,657 B2
(45) Date of Patent: Dec. 14, 2010

(54) CONNECTOR FOR FRAMES USED IN BUILDING

(75) Inventors: Kurt Schnepf, Victoria (AU); Benjamin Gordon Stevens, Victoria (AU)

(73) Assignee: Studco Building Systems Pty Ltd, Victoria (AU)

( * ) Notice: Subject to any disclaimer, the term of this patent is extended or adjusted under 35 U.S.C. 154(b) by 349 days.

(21) Appl. No.: 11/875,053

(22) Filed: Oct. 19, 2007

(65) Prior Publication Data

US 2008/0172969 A1 Jul. 24, 2008

(30) Foreign Application Priority Data

Oct. 20, 2006 (AU) ..... 2006905834

(51) Int. Cl.
*E04C 2/38* (2006.01)

(52) U.S. Cl. ..... 52/656.9; 403/292

(58) Field of Classification Search ..... 403/292, 403/231; 52/656.9, 204.1
See application file for complete search history.

(56) References Cited

U.S. PATENT DOCUMENTS

| | | | | |
|---|---|---|---|---|
| 3,592,493 | A * | 7/1971 | Goose | 403/247 |
| 4,013,372 | A * | 3/1977 | Lay et al. | 403/237 |
| 4,464,074 | A * | 8/1984 | Green et al. | 403/192 |
| 5,375,383 | A * | 12/1994 | Lin et al. | 52/217 |
| 6,282,851 | B1 | 9/2001 | Beaton | |
| 7,596,912 | B2 * | 10/2009 | Ito et al. | 52/204.5 |

* cited by examiner

*Primary Examiner*—Jeanette E Chapman
*Assistant Examiner*—Daniel Kenny
(74) *Attorney, Agent, or Firm*—Rofl Fasth; Fasth Law Offices

(57) ABSTRACT

A clip or connector is provided for assembling part of a door or window frame having first and second sheet material frame members to be retained in abutting relationship and in a particular predetermined position relative to each other. Each frame member has a concave channel formation along its length. The clip has a head and a body with a neck therebetween. The head engages with a tight interference or frictional fit within the channel formation of the first frame member and the body engages with a tight interference or frictional fit within the channel of the second frame member, such that the frame members are located and held in their particular predetermined position.

5 Claims, 6 Drawing Sheets

CONNECTOR FOR FRAMES USED IN BUILDING

CROSS-REFERENCE TO RELATED APPLICATIONS

The present application claims priority from Australian Provisional Patent Application No 2006905834 filed on 20 Oct. 2006.

FIELD OF THE INVENTION

The present invention relates to a connector, clip or assembly for holding together frame members used in the building industry.

BACKGROUND OF THE INVENTION

Metal frames have been used in the building industry to replace the need for similar architraves and the like around door and window frames. Door frames for example conventionally comprise three members: a horizontal member ("head") and two door stiles which extend vertically at 90° from the head. The entire assembly is sometimes referred to as the door jamb, and sometimes the stiles are referred to as "jambs". The terminology used herein may vary but the context should make the intention clear. Window frames are of similar construction but have four members. Such frame members comprise lengths of rolled steel sheeting having the appropriate profile for the desired use. For example, the door frames described in Patent Specification WO 97/42390 (Australian Patent No. 730616) have a channel running the length of the member to provide a door or window stop. These stops provide a surface for the closed door to abut and thereby seal off one area from another. While door frames such as those described in the patent specification mentioned above represent cost savings in terms of carpentry required to finish a building they do have drawbacks.

One difficulty is the need to assemble the frame members and retain them at the correct angle while they are being installed. For example the frame members may be assembled by welding or by cutting rebates at the ends of the head member and folding down "tabs" of metal to connect the head with the stiles. The assembly of frame members such as those of the patent specification mentioned above is difficult particularly because each frame member has a two part nature to enable the frame member to be selectively variable in width.

The above references to and descriptions of prior proposals or products are not intended to be, and are not to be construed as, statements or admissions of common general knowledge in the art in Australia or elsewhere.

SUMMARY OF THE INVENTION

An object of the present invention is to provide a clip or connector which can be effective to locate and hold frame members in their desired spatial relationship, and which preferably is relatively simple to use.

In a first aspect the present invention provides a clip for use in assembling part of a frame used in a building structure wherein first and second frame members are to be retained in abutting relationship and in a particular predetermined position relative to each other, wherein each of the frame members is made of sheet material and has a concave formation such as a channel along its length, the clip comprising a head and a body with a neck therebetween, wherein the head is adapted to be engaged within The concave formation of the first frame member and the body is adapted to be engaged within the concave formation of the second frame member, the head and the neck and the body being disposed relative to each other such that the frame members are located and held in their particular predetermined position by the clip when the head and body are engaged within their respective concave formations.

References herein (including in the claims and in summaries of the invention) to the frame members being made of sheet material is to be construed to include members composed of flat sheet(s) formed into the desired profile, extruded metal or plastics members having a relatively small thickness compared to the member's width or length, moulded metal or plastics members having a relatively small thickness compared to the member's width or length, and similar or equivalent constructions.

In one embodiment the head is proportioned to form a frictional fit within the concave formations of the first frame member so as to be locatable and held in position therein without fixing means such as screws, adhesives, or the like. Preferably the clip is designed to be used with a first frame member which has opposite walls and the frictional fit is between the opposite walls. The first frame member may have a connecting web between the opposite walls and further may have a return portion opposite and spaced from the connecting web and there may be frictional fit of the clip between the return portion and the connecting web. Preferably the frictional fitting is achieved by chamfered surfaces on the head of the clip which contact the concave formations of the first frame member and also facilitate manual location of the head within the concave formations.

In one preferred embodiment a clip according to the invention the clip of any preceding claim wherein at least one of the head and the body has a projection extending therefrom which, upon forcing of the clip into operative engagement with one of the frame members, shears off or distorts so as to form a tight interference fit of the clip with the frame member resisting displacement or disengagement of the assembly of the clip with the frame member.

Preferably the concave formations are channels which comprise door or window stops. More preferably the clip includes a clamping portion operative to clamp a portion of the concave formations of the first frame member and thereby locate the clip so that the body is positioned to engage within the concave formations of the second frame member and locate and hold second member in its required relative position. More preferably the clamping portion is defined by spaced opposite faces of the head and body between which a portion of the concave formations of the first frame member is received.

In a second aspect the present invention provides a connector for connecting and holding two frame members of a building structure in abutting relationship and in a particular predetermined position relative to each other, where the frame members are elongate, made of sheet material and used in the building structure to form a door or window frame or the like, the connector including a clamping portion for clamping engagement with an end of one of the frame members, and a locating portion extending from the clamping portion and engageable with the other of the frame members for locating the other of the frame members so that the two frame members can be located and held in abutting relationship and in a particular predetermined position relative to each other.

Preferably the connector is adapted to connect two frame members each of which has a concave formation, such as a channel along its length, wherein the clamping portion is provided by a first lug and a second lug joined by a neck wherein the neck is of a length such that it allows spaced opposed faces on the first lug and on the second lug to form a tight friction fit over an end of the concave formation of the one member.

Preferably the locating portion is provided by the second lug which slidably engages the concave formations of the other frame member.

More preferably the connector is adapted to fit frame members in which the concave formations comprise channels which constitute window or door stops.

More preferably the connector allows the members to be connected at an included angle of substantially 90° and the neck is of minimal length to allow the stops to be accurately aligned and the connector when installed is virtually invisible at the vertex of the angle.

In a third aspect the present invention provides an assembly of part of a door or window frame wherein the part frame is formed of a head member and a stile or jamb member, each member having a channel which provides a door or window stop, each of the members having an end, the members being located such that the ends abut and are positioned such that the stops are aligned and the members extend from each other at a required angle (such as 90°), the assembly comprising a clip locating the members in their desired relative position, the clip comprising a first lug joined to a neck portion which is joined to a second lug, the first lug being engaged within the channel of either the jamb or the head member, and the second lug being engaged within the channel of other of the jamb or the head member, the neck portion and lugs being configured such that the members are held in the desired relative position and the stops are accurately aligned with each other.

Preferably when the clip is in use the first and second lugs are spaced such that they provide a friction fit over a portion of the head or the jamb member which is located between the spaced lugs.

More preferably the system provides a clip wherein the lug is adapted to slide into the channel along the axis of that channel, the second lug is adapted such that the channel of the other member can be slid onto the second lug along its axis, the lugs being arranged such that the axes are at an angle of substantially 90°.

In a fourth aspect the present invention provides a method of assembling a part of a door or window frame comprising a head member, a stile or jamb member, and a connector, each the member having a channel which forms a door or window stop, the connector comprising a head and a body and a neck therebetween, the method including the steps of checking out a wall portion of the channel of one of the members at an end thereof, inserting the head of the connector into the channel having the checked out portion so that the neck extends through the checked out portion and the body is located outside the channel in a position to receive the channel of the other member, and assembling the other member so that its channel receives the head therein and so that the head member and stile or jamb member are located and held in their particular predetermined relative position by the connector during the installation of the door or window frame in a building construction.

BRIEF DESCRIPTION OF THE DRAWINGS

Possible and preferred features of the present invention will now be described with particular reference to the accompanying drawings. However it is to be understood that the features illustrated in and described with reference to the drawings are not to be construed as limiting on the scope of the invention. In the drawings.

DETAILED DESCRIPTION OF EMBODIMENT

The connector or clip of the invention will now be described with reference to assembly of a door frame, however it will be appreciated that other frames made of elongate sheet material, of metal, plastic or other substances may be assembled using the connector.

Figure 1:
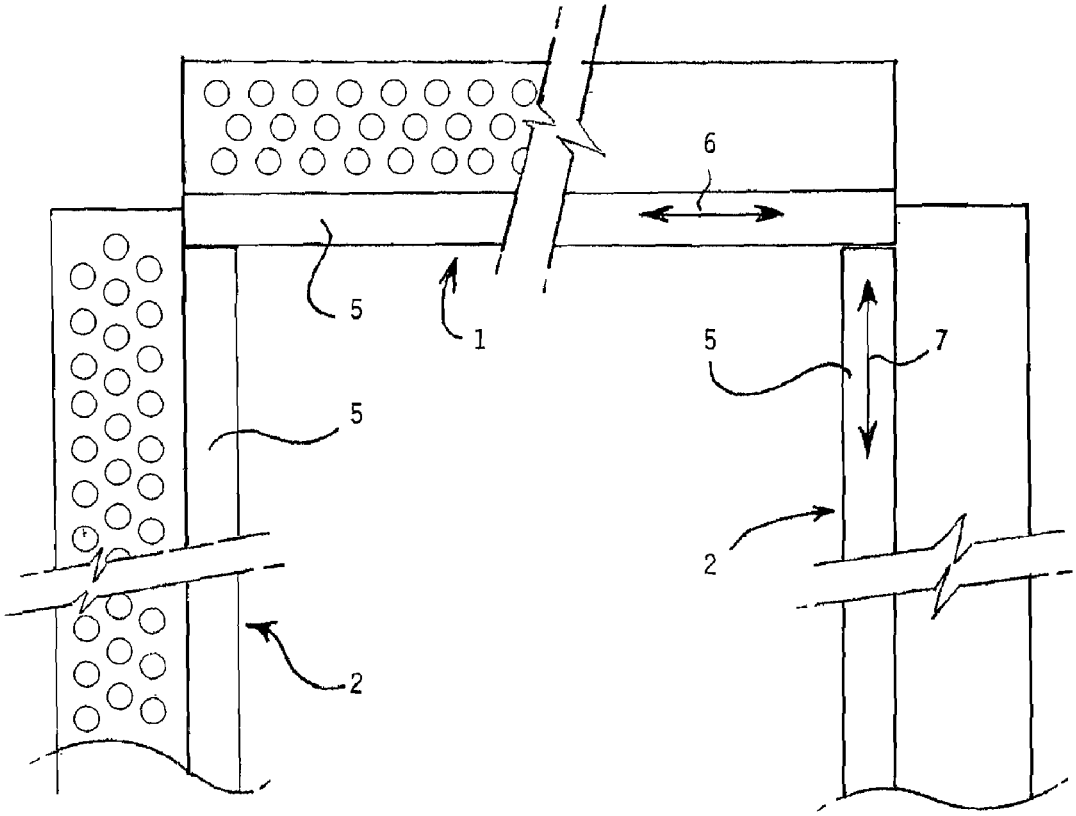
FIG. 1 is a fragmentary view of a door frame showing on the left hand side the frame prior to the skim coat of plaster and the right hand side having the skim coat of plaster applied.
Figure 2:
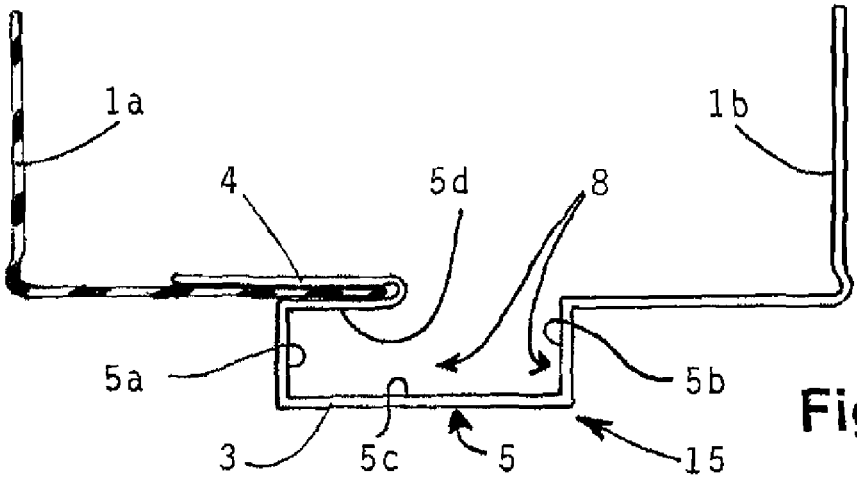
FIG. 2 is a cross-section of an expandable frame member that may be used.
Figure 3:
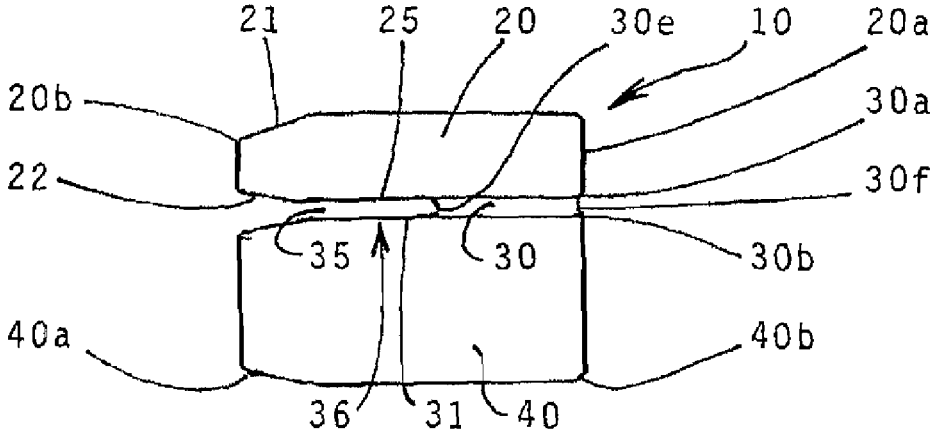
FIG. 3 is a side view of the clip or connector of a first embodiment of the present invention.
Figure 4:
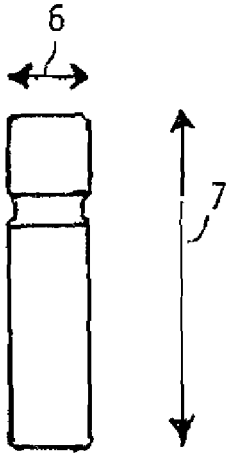
FIG. 4 is an end view of the clip/connector of FIG. 3.
Figure 5:
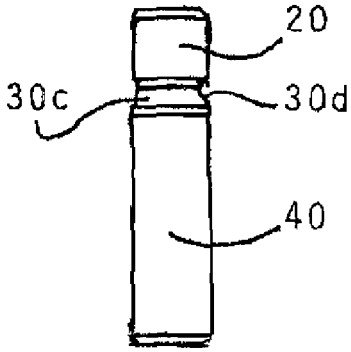
FIG. 5 is the opposite end view of the clip/connector of FIG. 3.
Figure 6:
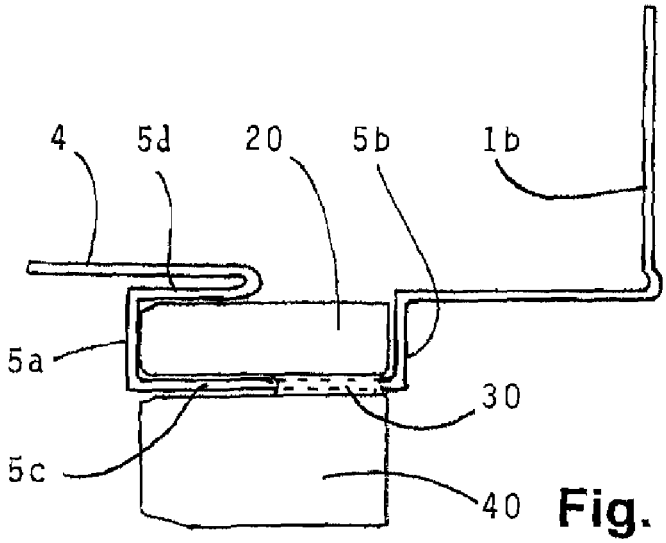
FIG. 6 is an end view of the clip/connector attached to a frame member.
Figure 7:
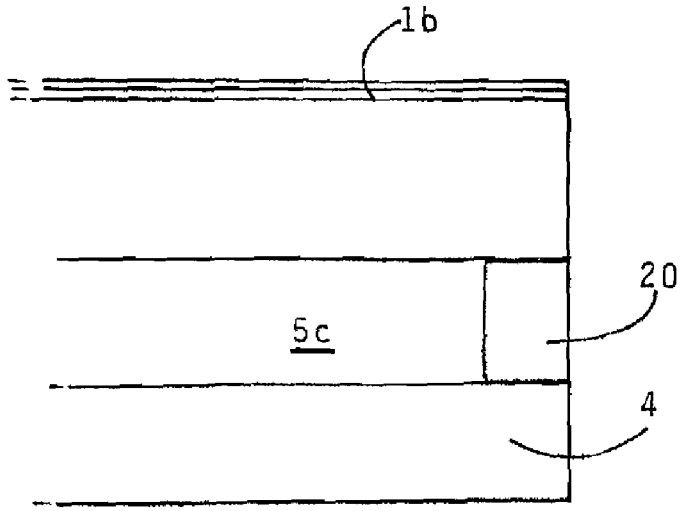
FIG. 7 is a top plan view of the clip/connector and frame member of FIG. 6.
Figure 8:
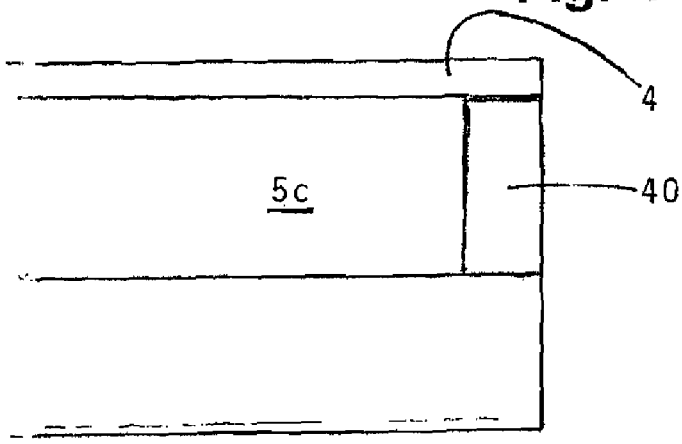
FIG. 8 is an underneath plan view of that shown in FIG. 6.
Figure 9:
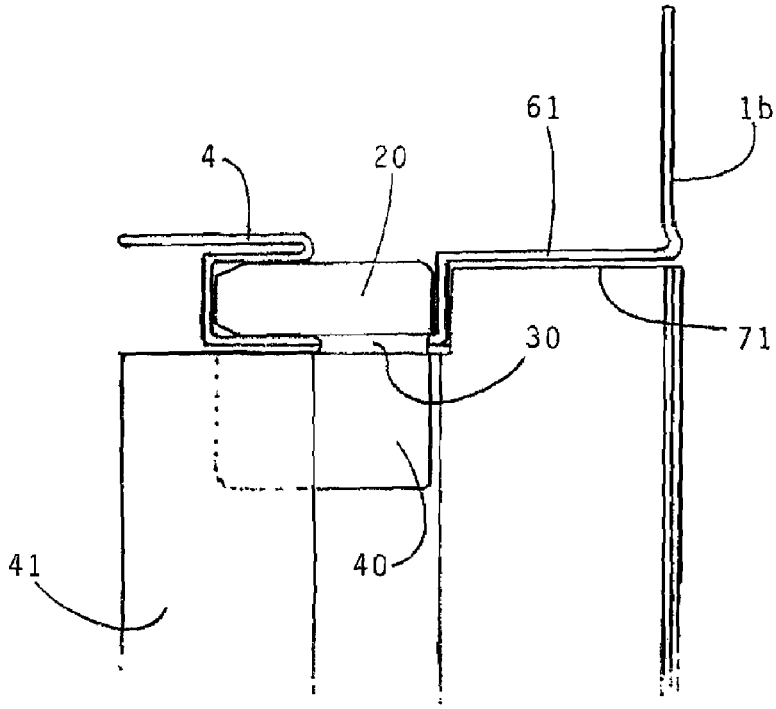
FIG. 9 is a side view of a head member and a jamb member assembled with the clip/connector of the present invention.
Figure 10:
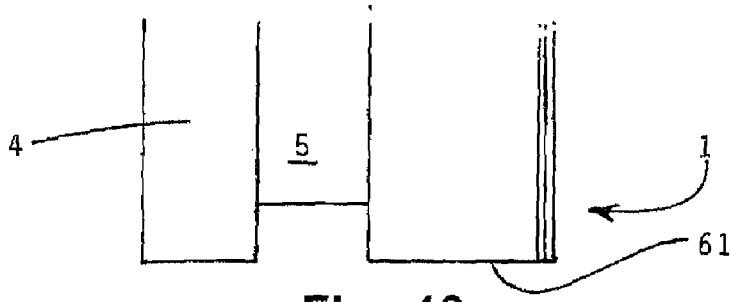
FIG. 10 is a top plan view of the head member showing the appropriate rebate to receive the clip/connector.
Figure 11:
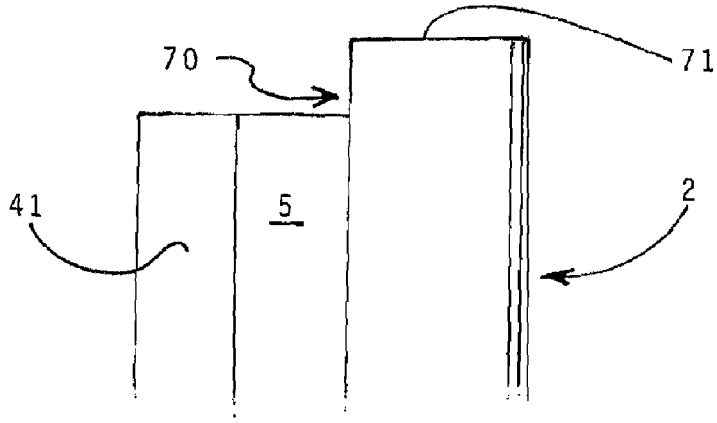
FIG. 11 is a side view showing the appropriate rebate of the jamb member.
Figure 12:
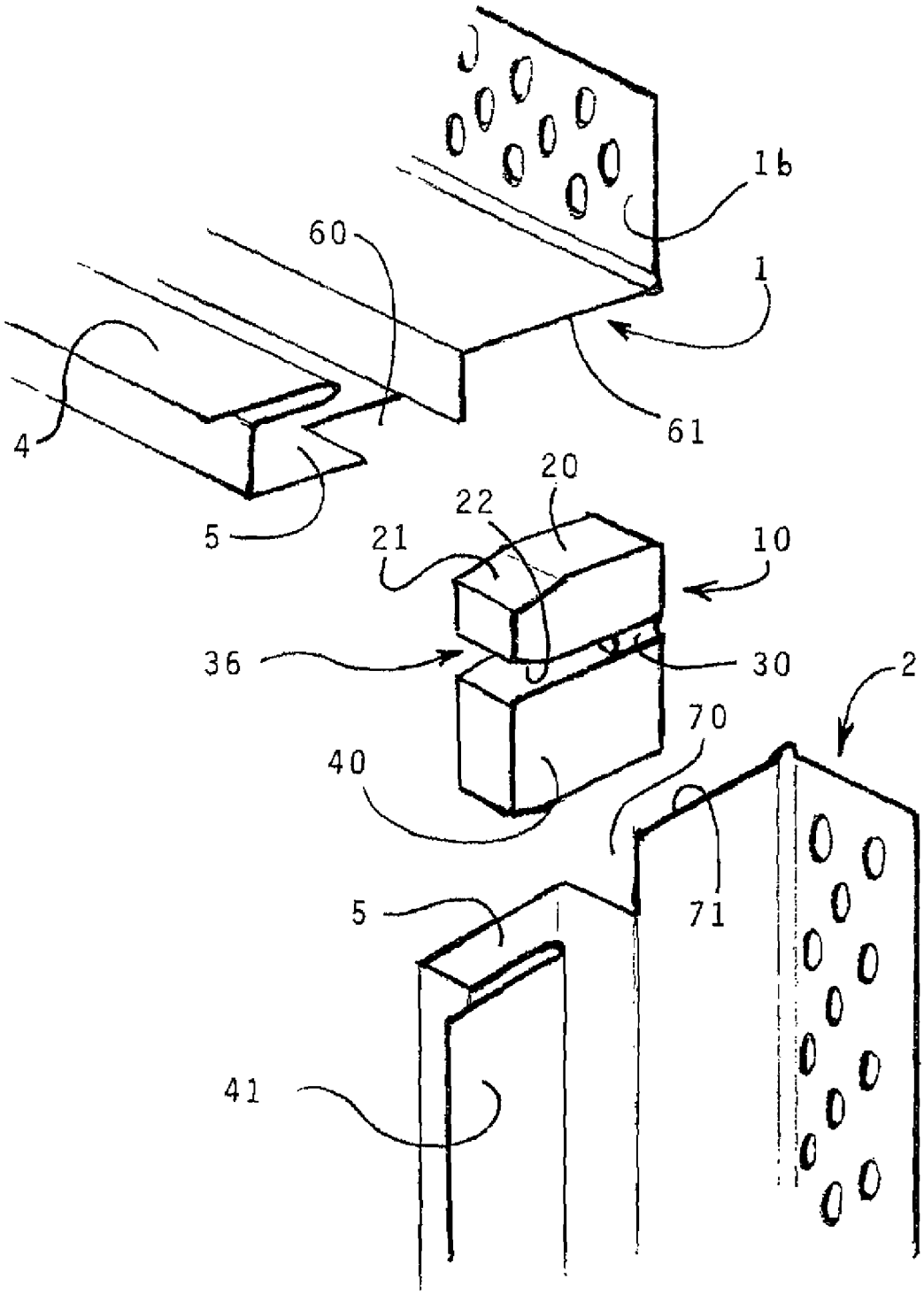
FIG. 12 is an exploded perspective view of the frame corner assembly.
Figure 16:
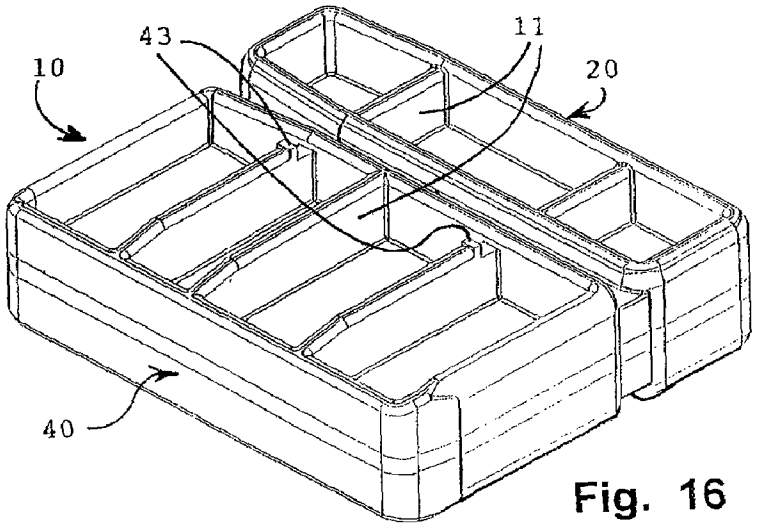
FIG. 16 is a perspective view of the clip/connector of FIG. 13.

Door frames are constructed of a head member 1 and two stile or jamb members 2. The jamb members extend 90° from the head member (FIG. 1).

The members are made of sheet metal sections of width 3 which may be made of two parts 1*a* and 1*b* such that the member is expandable to the width of a door cavity. Specifically folded portion 4 of piece 1*b* defines a slot into which part 1*a* can be inserted. The metal section has a concave formation which in the illustrated embodiment is a channel 5 which forms a door stop on the exposed side 15 which may be painted when the frame is installed in a door cavity. In the interests of a well fitting door, the door jamb members should be fixed at right angles to the door head member, and the door stops 5 of the head and jambs accurately aligned so that when the door is shut a good seal between the door and the door stops 5 is achieved.

Channel 5 on head member 1 runs along a first axis 6 whereas channel 5 on jamb member 2 runs along a second axis 7 which is at 90° to the first axis.

The connector of the present invention takes advantage of this axial relationship between the channels of the two members by engaging with one member and thereby providing a locating and retaining means for the other member to adopt its desired relative position. In particular, this allows the door stops formed by the channels 5 to be accurately aligned.

It can be seen that channel 5 when viewed in profile has an internal width 8 defined by opposite walls 5*a* and 5*b*. One wall 5*a* is shallower in depth than its opposite wall 5*b*. Opposite walls 5*a* and 5*b* are connected by web 5*c*. Return portion 5*d* is opposite web 5*c*. These features are made use of in the connector of the invention described below.

The connector/clip 10 of the invention is an integral unit of moulded plastic or other suitable rigid or semi-rigid material and comprises a first lug (or head) 20 which is basically a rectangular shape with surfaces 21 and 22 which slope in towards each other to form a chamfer which facilitates insertion of the connector into channel 5 between the opposed walls 5*c* and 5*d*.

Neck 30 extends from one end of lug 20 and its length shown by points 30*a* and 30*b* in the drawings may be slightly less than, equal to, or slightly more than the width 3 of the sheet material of head member 1. Neck 30 has a width (shown by points 30*c* to 30*d*) and a depth (shown by 30*e* to 30*f*) which is important when the appropriate rebate is checked out of head member 1 (described later).

Second lug (body) 40 extending from neck 30 is basically rectangular in shape of larger dimension than first lug 20 and extends in the same direction (from neck 30) as first lug 20.

On one side where it extends from lug 20, neck 30 is only defined by a slight indentation indicated by points 30*a* and 30*b* in the drawings.

Together first lug 20 and second lug 40 define a space 35 where a member engaging surface or face 25 of lug 20 opposes member engaging surface or face 31 of second lug 40. Space 35 is of appropriate dimension to fit the sheet width 3 of the frame member to provide a tight friction fit. The connector 10 by this configuration provides a clamping portion 36 constituted by faces or surfaces 25 and 31. The clamping portion 36 is operative to clamp a portion 5*c* of the channel formation 5 of the first frame member 1 and thereby locate the clip 10 so that the second lug or body 40 constitutes a locating portion positioned to engage within the channel formation 5 of the second frame member 2 and locate and hold the second frame member in its required relative position.

The depth of first lug 20 denoted by points 20*a* and 20*b* is the same as the depth of second lug 40 denoted by points 40*a* and 40*b* and is suitable to fit the internal width 8 of channel 5.

In use connector 10 is inserted into channel 5 of head member 1 by sliding first lug 20 along axis 6. An appropriate rebate 60 is checked out of part of channel 5 of head member 1 to allow connector 10 to sit substantially flush with end 61. The rebate is suitable to accommodate the dimensions of neck 30 defined by points 30*c* to 30*d* and 30*e* to 30*f*. Jamb member 2 is then slid onto second lug 40 along axis 7 which axis is at right angles to axis 6. A larger rebate 70 is checked out of channel 5 of jamb member 2 to allow edge 1 to sit substantially flush with edge 61.

Referring to FIGS. 13 to 16 where the same reference numerals have been used for corresponding parts in the first embodiment, the connector 10 is made of a moulded plastics or other suitable material having a concave construction of the lugs 20, 40 with transverse ribs 11. Using this construction rather than the solid mass illustrated in the first embodiment can use less material without sacrificing strength. The construction also allows some limited distortion or movement of the components of the connector 10 when being inserted into the channels of the frame members to be joined particularly if there is a very tight fit.

Figure 14:
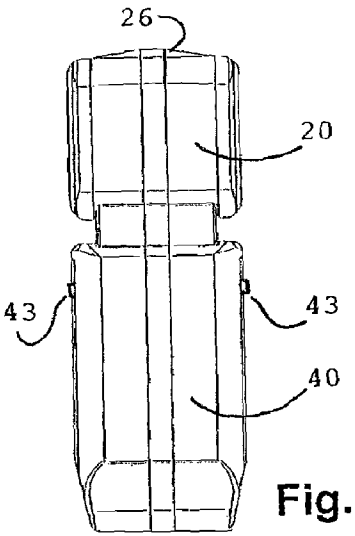
FIG. 14 is an end view of the clip/connector of FIG. 13.
Figure 15:
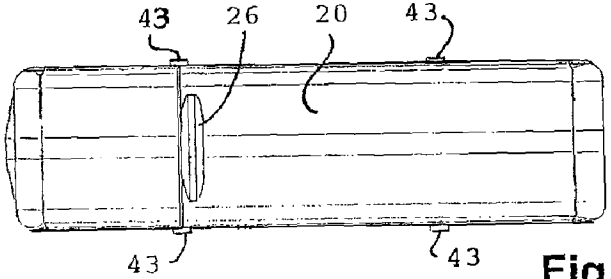
FIG. 15 is top view of the clip/connector of FIG. 13.
Figure 13:
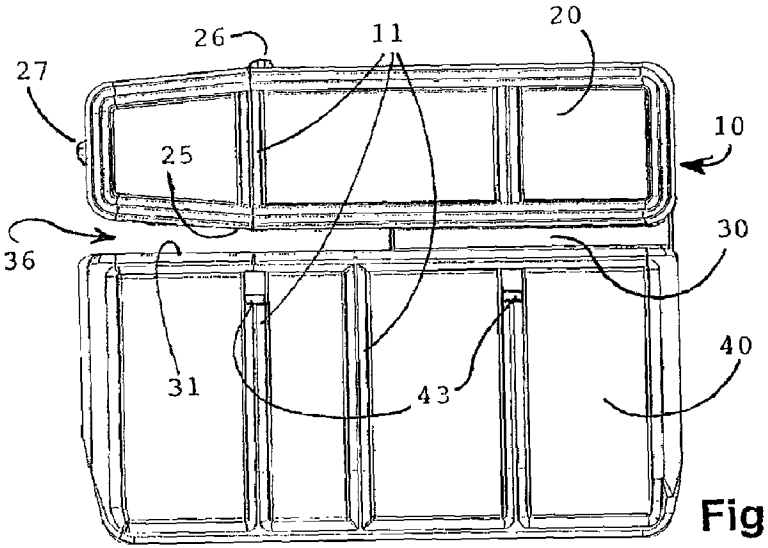
FIG. 13 is a side view of a clip or connector of a second embodiment of the present invention.

The body 40 has projections 43 in the form of small lugs which project slightly outwardly (beyond the general plane of the side faces of the body 40 as best seen in FIGS. 14 and 15) so that when the body 40 is inserted into the channel 5, the projections 43 inhibit complete insertion of the body 40 into the channel 5 to its operative position. This partial insertion enables the connector to be installed in this manner when the frame components are being delivered to the customer. During use, the customer then applies a sharp force, such as a blow with a hammer, to the head 20 so that the projections 43 shear off or distort and so that the body 40 then enters and forms a tight fit within the channel 5 regardless of material or manufacturing tolerances of the associated frame member.

The external faces of the head or first lug 20 also have projections 26, 27 show as surface ridges which likewise enable a connector to be loosely assembled with the frame member 1 for initial supply and delivery. Thus the connector, if desired, can be assembled with the frame member 1 by inserting the head 20 into the channel 5 in the general longitudinal direction of the channel so that the neck 30 enters the rebate 60 partially until the projections 26, 27 frictionally significantly resist further insertion without application of considerable force. When the user is ready to assemble the components, a sharp force such as a hammer blow applied to the outside face of the head 20 in the direction of the channel 5 will cause the projections 26, 27 to shear off, or be shaved, or distort, or cause some distortion of the channel walls so that the connector is tightly held in position ready for assembly of the frame member 2 with the body 40 in precisely the desired relationship with the frame member 1.

In use the connector allows accurate positioning of the angle of the door frame and accurate alignment of the stops. The connector also can be substantially hidden from view once the door frame is installed. Any gaps between the two members at the vertex of the 90° angle where the two members join can be filled with an appropriate filler.

When used in this specification and claims, the terms "comprises" and "comprising" and variations thereof mean that the specified features, steps or integers are included. The terms are not to be interpreted to exclude the presence of other features, steps or components.

It is to be understood that various alterations, modifications and/or additions may be made to the features of the possible and preferred embodiment(s) of the invention as herein described without departing from the spirit and scope of the invention.

The invention claimed is:

1. An assembly of part of a door or window frame wherein a part frame is being formed of a head member and a stile or jamb member, each member having a channel defined therein which provides a door or window stop, each of said members having an end, said members being located in a desired relative position such that the ends are adjacent each other and such that the stops are being aligned and the members are extending from each other at a required angle, said assembly comprising:

a clip locating said members in said desired relative position, said clip having a first lug joined to a neck portion which is joined to a second lug, said first lug being engaged within said channel of either the jamb and the head member, and said second lug being engaged within said channel of other of the jamb and the head member, said neck portion and lugs being configured such that said members are being held in said desired relative position and the stops are being accurately aligned with each other, said first and second lugs are spaced such that the first and second lugs provide a friction fit over a portion of the end of said head member or said jamb member which is located between the spaced lugs.

2. The assembly of claim 1 wherein said first lug is engaged within said channel of one of said members by sliding into that channel along the axis of that channel, said second lug is adapted such that said channel of said other member is engaged with said second lug by sliding along its axis onto said second lug, said lugs being arranged such that the channel axes are at an angle of substantially 90°.

3. The assembly of claim 1 wherein the channel of the jamb or head member within which the first lug is engaged has opposite walls and there is a frictional fit of the first lug between the opposite walls.

4. The assembly of claim 1 wherein the channel of the jamb or head member within which the first lug is engaged has opposite walls and a connecting web between the opposite walls and further has a return portion opposite and spaced from the connecting web, and wherein there is a frictional fit of the first lug between the return portion and the connecting web.

5. The assembly of claim 1 wherein at least one of said first lug and said second lug has a projection extending therefrom which, upon engagement of the first lug or second lug having the projection within the associated channel of the jamb or head member, the projection was sheared off or distorted so as to form a tight interference fit of the first or second lug with the channel resisting displacement or disengagement of the assembly of the clip with the jamb and head members.

* * * * *